US006808125B2

(12) United States Patent
Ruthardt et al.

(10) Patent No.: US 6,808,125 B2
(45) Date of Patent: Oct. 26, 2004

(54) COMMON RAIL INJECTOR

(75) Inventors: Siegfried Ruthardt, Altdorf (DE); Juergen Hanneke, Stuttgart (DE); Prakash-George Anthony, Stuttgart (DE); Holger Rapp, Hemmingen (DE)

(73) Assignee: Robert Bosch GmbH, Stuttgart (DE)

( * ) Notice: Subject to any disclaimer, the term of this patent is extended or adjusted under 35 U.S.C. 154(b) by 12 days.

(21) Appl. No.: 09/844,273

(22) Filed: Apr. 30, 2001

(65) Prior Publication Data

US 2002/0033423 A1 Mar. 21, 2002

(30) Foreign Application Priority Data

Apr. 28, 2000 (DE) ..... 100 20 867

(51) Int. Cl.[7] ..... F02M 47/02; F02M 59/00; F02M 61/00; F02M 63/00

(52) U.S. Cl. ..... 239/89; 239/533.2

(58) Field of Search ..... 239/88, 89, 90, 239/91, 92, 93, 94, 95, 96, 533.11, 533.9, 533.6, 533.2, 537, 539, 541; 123/467, 456

(56) References Cited

U.S. PATENT DOCUMENTS

| | | | | | |
|---|---|---|---|---|---|
| 3,499,605 | A | | 3/1970 | Dreisin et al. | |
| 5,110,053 | A | * | 5/1992 | Stevens | 239/533.9 |
| 5,110,054 | A | * | 5/1992 | Stevens | 239/533.11 |
| 5,413,076 | A | * | 5/1995 | Koenigswieser et al. | 123/446 |
| 6,027,037 | A | * | 2/2000 | Murakami et al. | 239/88 |
| 6,102,302 | A | * | 8/2000 | Nishimura | 239/96 |
| 6,360,963 | B2 | * | 3/2002 | Popp | 239/132.5 |
| 6,375,098 | B1 | * | 4/2002 | Fuseya et al. | 239/533.11 |
| 6,382,189 | B1 | * | 5/2002 | Hlousek | 123/506 |
| 2001/0013556 | A1 | * | 8/2001 | Ganser | 239/88 |

FOREIGN PATENT DOCUMENTS

| | | | | |
|---|---|---|---|---|
| DE | 39 37 955 | A1 | 5/1991 | |
| DE | 196 34 105 | A1 | 1/1998 | |
| DE | 198 25 171 | A1 | 7/1999 | |
| EP | 0 971 118 | A2 * | 1/2000 | F02M/47/02 |

* cited by examiner

*Primary Examiner*—Michael Mar
*Assistant Examiner*—Darren Gorman
(74) *Attorney, Agent, or Firm*—Ronald E. Greigg

(57) ABSTRACT

The invention relates to a common rail injector for injecting fuel in a common rail injection system of an internal combustion engine, having an injector housing which communicates with a central high-pressure reservoir and in which a nozzle needle that cooperates with a valve piston which is guided in a valve piece is axially displaceable. To increase the service life of the injector, the end toward the nozzle needle of the valve piston or of a thrust rod triggered by the valve piston is guided coaxially to the axis of symmetry of the nozzle needle.

28 Claims, 4 Drawing Sheets

COMMON RAIL INJECTOR

BACKGROUND OF THE INVENTION

1. Field of the Invention

The invention relates to a common rail injector for injecting fuel in a common rail injection system of an internal combustion engine, having an injector housing which communicates with a central high-pressure reservoir and in which a nozzle needle that cooperates with a valve piston which is guided in a valve piece is axially displaceable.

2. Description of the Prior Art

In common rail injection systems, a high-pressure pump pumps the fuel into the central high-pressure reservoir, which is known as a common rail. In the high-pressure reservoir, high-pressure lines lead to the individual injectors, which are assigned to the various engine cylinders. The injectors are triggered individually by the engine electronics, each via a respective control valve. When the control valve opens, fuel subjected to high pressure flows past the nozzle needle, which at that time is raised, into the combustion chamber.

In conventional injectors, of the kind described for instance in European Patent Disclosure EP 0 604 915 B1, the nozzle needle is triggered by a valve piston via a thrust piece. The valve piston is guided in a valve piece, which is secured in the injector housing. The axis of symmetry of the valve piston does not necessarily in practice match that of the nozzle needle. The result can be increased wear at the nozzle needle guide. Furthermore, contact between the thrust piece and the injector housing in operation can cause changes in friction, which can impair the operating performance of the injector, especially at low rail pressures.

OBJECT AND SUMMARY OF THE INVENTION

The object of the invention is to increase the service life of the known injectors by simple means. Nevertheless, it should be possible to produce the injector of the invention economically.

In a common rail injector for injecting fuel in a common rail injection system of an internal combustion engine, having an injector housing which communicates with a central high-pressure reservoir and in which a nozzle needle that cooperates with a valve piston which is guided in a valve piece is axially displaceable, this object is attained in that the end of the nozzle needle toward the valve piston protrudes into a guide sleeve, in which the end, toward the nozzle needle, of the valve piston or of a thrust rod triggered by the valve piston is received.

To increase the service life of the injector, the end toward the nozzle needle of the valve piston or of a thrust rod triggered by the valve piston is guided coaxially to the axis of symmetry of the nozzle needle.

This assures that the closing force is always introduced centrally into the nozzle needle, and an undesired tilting moment on the nozzle needle is averted. The thrust piece used in conventional injectors can be omitted. Hence the undesired change in friction described above can no longer occur.

In a particular embodiment of the invention, the elongated valve piston in conventional injectors is divided up into a short valve piston, which absorbs the hydraulic forces from the control chamber and seals off the control chamber from the low-pressure region, and a thrust rod, which serves to transmit force from the valve piston to the nozzle needle. The pivotable disposition of the thrust rod can be attained for instance by providing that the thrust rod tapers on its end toward the valve piston.

The above-stated object is also attained in that the valve piston, below its guidance in the valve piece, is deflected elastically out of its axis of symmetry, which is predetermined by the axis of symmetry of a guide in the valve piece. If the bending elasticity of the valve piston is already slight enough, then the valve piston can be used unchanged in the injector of the invention. However, if the bending elasticity of the valve piston and thus also the forces required to deflect its end toward the nozzle needle are too high, then below its guidance in the valve piece the valve piston is tapered, which reduces its bending elasticity. The bending elasticity allows a slight deflection of the end, toward the nozzle needle, of the valve piston out of its axis of symmetry toward the axis of symmetry of the nozzle needle. This assures that any axial offset that may exist between the valve piece and the nozzle needle can be compensated for. That in turn assures that the closing force is always introduced centrally into the nozzle needle, and an undesired tilting moment on the nozzle needle is prevented.

The aforementioned object is also attained in that in the end of the nozzle needle toward the valve piston, a blind bore is embodied centrally, in which the end of the thrust rod, or of the valve piston, toward the nozzle needle is received. This assures that the closing force is introduced centrally into the nozzle needle.

The above object is also attained in that on the end of the nozzle needle toward the valve piston, a thrust peg is embodied, which protrudes into a guide sleeve in which the end of the thrust rod or of the valve piston toward the nozzle needle is received. This assures that the closing force is introduced centrally into the nozzle needle.

Another particular embodiment of the invention is characterized in that between the guide sleeve and a nozzle spring, on the face end of the guide sleeve remote from the nozzle needle, there is a bearing disk, which forms an abutment for the nozzle spring. The bearing disk serves to introduce the closing force of the nozzle spring into the nozzle needle. The nozzle spring serves to exert a defined closing force on the nozzle needle even when the system is pressureless.

Another particular embodiment of the invention is characterized in that the guide sleeve, on its face end remote from the nozzle needle, has a collar which forms an abutment for the nozzle spring. The collar serves to introduce the closing force of the nozzle spring into the nozzle needle.

Another special embodiment of the invention is characterized in that the dimensions of the guide sleeve, on its face end remote from the nozzle needle, are adapted to the dimensions of the nozzle spring. As a result, it is attained that the closing force of the nozzle spring is introduced into the nozzle needle without the formation of a collar and without using a bearing disk. The prestressing force of the nozzle spring can be adjusted by way of the thickness of the bearing disk, the thickness of the collar, the length of the guide sleeve, or by way of a further shim between the nozzle spring and its bearing place in the injector housing.

Another particular embodiment of the invention is characterized in that the guide sleeve, on its face end toward the nozzle needle, has a cylindrical recess on the inside. The cylindrical recess serves to receive one end of the nozzle needle.

Another particular embodiment of the invention is characterized in that an adjusting piece is disposed between the nozzle needle and the thrust rod or the valve piston. By the use of graded adjusting pieces, it is possible to adjust the nozzle needle stroke.

BRIEF DESCRIPTION OF THE DRAWINGS

The invention will be better understood and further objects and advantages thereof will become more apparent from the ensuing detailed description taken in conjunction with the drawings, in which.

DESCRIPTION OF THE PREFERRED EMBODIMENTS

Figure 1:
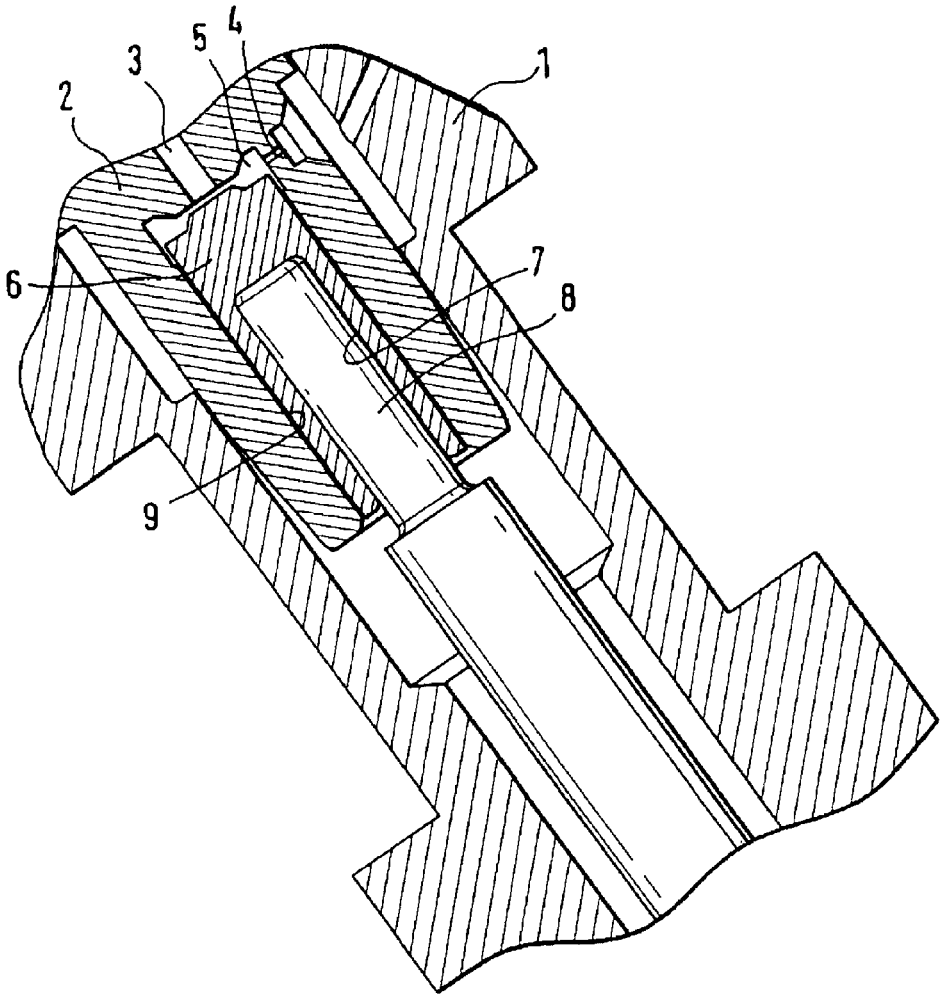
FIG. 1 shows the upper part of an injector of the invention in longitudinal section.

In FIG. 1, the upper part of an injector housing 1 is shown. A valve piece 2 is secured in the injector housing 1. A central blind bore 9 is cut out of the valve piece 2. A central outlet bore 3 originates at the end face of the blind bore 9. A central inlet bore 4 also discharges into the blind bore 9. The orifice region of the bores 3 and 4 of the blind bore 9 form a control chamber 5. As long as the outlet bore 3 is closed and the control chamber 5 is filled with fuel at high pressure via the inlet bore 4, the injector is closed. When the control chamber 5 is relieved via the outlet bore 3 into a relief chamber (not shown), the injector opens.

The control chamber 5 is defined by the end face of a valve piston 6. On the side of the valve piston 6 remote from the control chamber 5, there is a blind bore 7. In the blind bore 7, one end of a thrust rod 8 is received in such a way that the thrust rod 8 can be inclined slightly relative to the valve piston 6.

Figure 2:
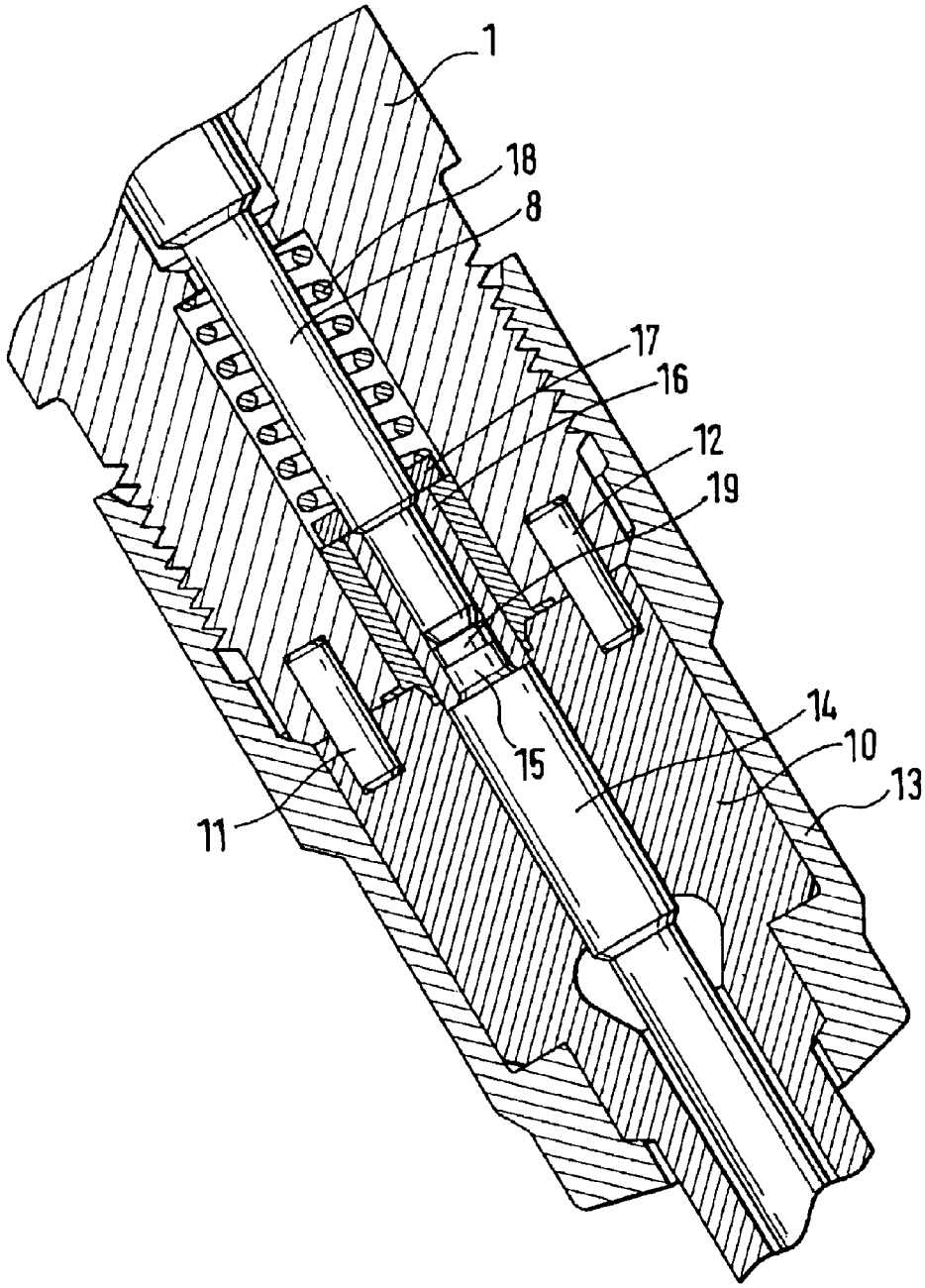
FIG. 2 shows the lower part of the injector of FIG. 1 in longitudinal section.

In FIG. 2, the lower part of the injector whose upper part is shown in FIG. 1 can be seen. A nozzle body 10 is affixed to the end of the injector housing 1 with the aid of two pins 11 and 12 and is secured with the aid of a lock nut 13. A nozzle needle 14 is received axially displaceably in the nozzle body 10. The end of the nozzle needle, shown cut off in FIG. 2, serves to open and close injection ports, not shown in FIG. 2, to enable a targeted injection of fuel at high pressure into the combustion chamber of the engine.

A thrust peg 15 is embodied on the other end of the nozzle needle 14. The thrust peg 15 is received in a guide sleeve 16. Via the guide sleeve 16, the nozzle needle 14 is coupled to the thrust rod 8. A shim 19 is disposed between the thrust rod 8 and the thrust peg 15 of the nozzle needle 14. The shim 19 serves to adjust the stroke of the nozzle needle 14.

A nozzle spring 18 is prestressed against the guide sleeve 16 in the injector housing with the aid of a shim 17. Via the shim or washer 17 and the guide sleeve 16, the prestressing force of the nozzle spring 18 is introduced into the nozzle needle 14. The prestressing force of the nozzle spring 18 can be adjusted via the thickness of the shim 17.

In FIGS. 3–6, different variants for how the valve piston 6 and thrust rod 8 can be centered relative to the nozzle needle 14 are shown.

Figure 3:
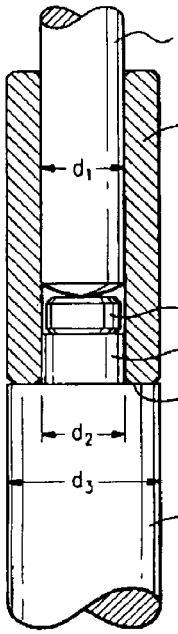
FIGS. 3–6 show different variants for centering the valve piston relative to the nozzle needle in longitudinal section.

In the variant shown in FIG. 3, a thrust peg 15 is embodied on the end of the nozzle needle 14 and is surrounded by an annular bearing face 20. The diameter of the thrust rod 8 or of the valve piston 6 is designated as $d_1$. The diameter of the thrust peg 15 is marked $d_2$. The diameter of the nozzle needle 14 is marked $d_3$.

Figure 4:
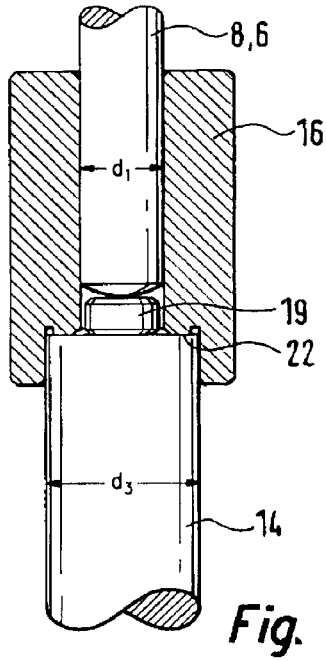

In the variant shown in FIG. 4, no thrust peg is embodied on the end of the nozzle needle 14. Instead, an encompassing step or cylindrical recess 22 is formed on the inside of the end of the guide sleeve 16. The step 22 extending all the way around on the inside forms a bearing surface for the nozzle needle 14.

Figure 5:
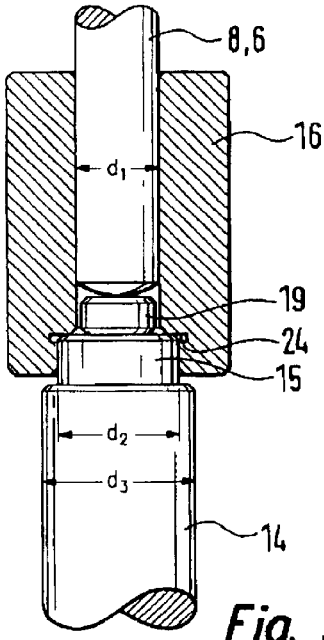
Figure 6:
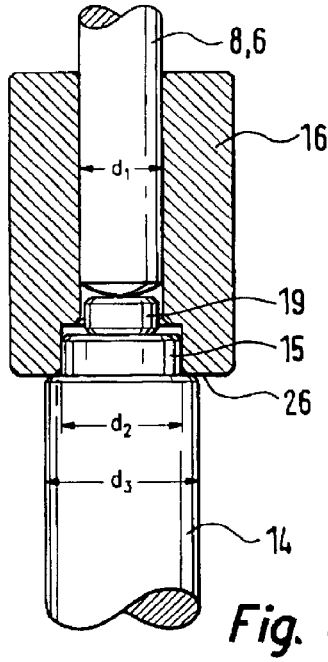

In the variants shown in FIGS. 5 and 6, the two variants shown in FIGS. 3 and 4 are combined with one another. The difference between the variants shown in FIG. 5 and FIG. 6 is that the guide sleeve 16 rests on different surfaces or faces on the face end of the nozzle needle 14. In the variant shown in FIG. 5, the bearing face is marked 24. In the variant shown in FIG. 6, the bearing face is marked 26. The dimensions of the guide sleeve 16 and the nozzle needle 14 in the end region are each selected such that a static redundancy in determination in the assembled state of the injector is reliably prevented.

Figure 7:
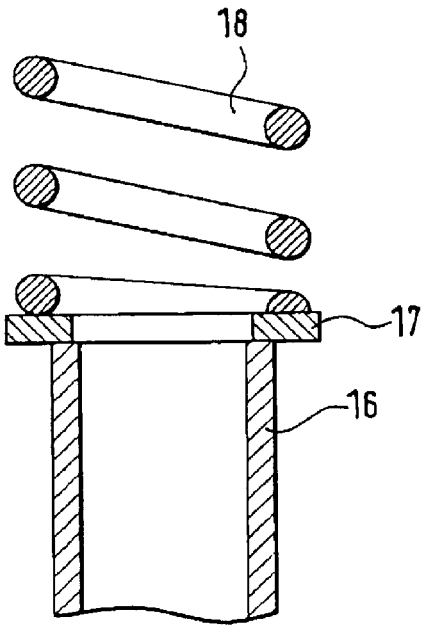
FIGS. 7–9 show three different variants for introducing a nozzle spring force into a guide sleeve.
Figure 8:
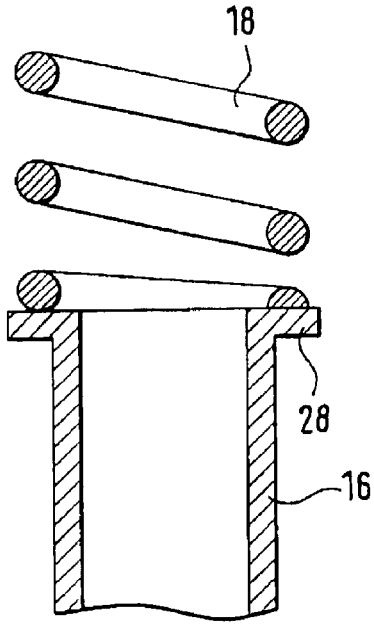
Figure 9:
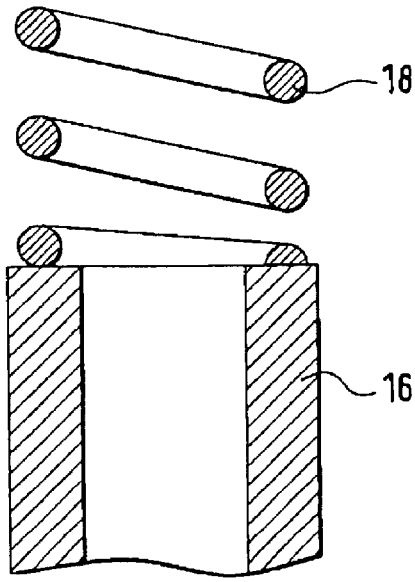

FIGS. 7–9 show three different variants for introducing a nozzle spring force into the guide sleeve 16.

In the variant shown in FIG. 7, a shim 17 is disposed between the guide sleeve 16 and the nozzle spring 18. The shim 17 serves to introduce the pressure force of the nozzle spring 18 into the guide sleeve 16.

In the variant shown in FIG. 8, for the same purpose, a collar 28 is embodied on the guide sleeve 16. The collar 28 is in one piece with the guide sleeve 16. This simplifies the assembly of the injector of the invention but at the same time has the disadvantage that when the thickness of the collar 28 is utilized to adjust the nozzle spring prestressing force, the entire guide sleeve has to be replaced.

In the variant shown in FIG. 9, the dimensions of the guide sleeve 16 are adapted in cross section to those of the nozzle spring 18. As a result, it is unnecessary either to use a shim or to embody a collar on the guide sleeve 16.

The nucleus of the present invention is the mutually coaxial guidance of both the end toward the nozzle needle of the valve piston or thrust rod and of the nozzle needle itself.

In a first embodiment, the valve piston is provided with a blind bore from the underside. The thrust rod is tapered on its upper end and is received with the taper in the blind bore of the valve piston. As a result, the control rod axis can be deflected by a limited angle relative to the valve piece axis.

In a second embodiment, the separation between the valve piston 6 and the thrust rod 8 is omitted, and instead the bending elasticity of the valve piston is utilized in order to deflect its end toward the nozzle needle out of the axis of symmetry of the valve piston and guided toward the axis of symmetry of the nozzle needle.

In the embodiment of the nozzle needle with a thrust peg, a guide sleeve which is longer than the thrust peg is slipped onto the thrust peg. The lower end of the thrust rod is received in this guide sheath. This assures that the closing force is introduced centrally into the nozzle needle.

Alternatively, instead of being provided with a thrust peg, the nozzle needle can be provided with a central blind bore, into which the lower end of the thrust rod is introduced. Then the centering of the force engagement point can be accomplished without an additional guide sleeve.

The foregoing relates to preferred exemplary embodiments of the invention, it being understood that other variants and embodiments thereof are possible within the spirit and scope of the invention, the latter being defined by the appended claims.

We claim:

1. The fuel injector for injecting fuel in an internal combustion engine, said injector having an injector housing (1) which communicates with a central high-pressure reservoir and a nozzle needle (14) that cooperates with a valve piston (6) which is axially displaceable and guided in a valve piece (2), the improvement wherein the end of the nozzle needle (14) toward the valve piston (6) protrudes into a guide sleeve (16), and the end of the valve piston (6), or an end of a thrust rod (8) triggered by the valve piston (6), oriented toward the nozzle needle (14) is also received in the guide sleeve (16), further comprising a cylindrical recess (22) formed on said guide sleeve (16), on its face end toward the nozzle needle (14), and wherein, on the end of the nozzle needle (14) toward the valve piston (6), a thrust peg (15) is positioned, said thrust peg protruding into the guide sleeve (16) or into a central blind bore formed on the end of the valve piston (6).

2. The fuel injector according to claim 1, wherein the valve piston (6) or thrust rod (8) and the guide sleeve (16) form a unit, and wherein a blind bore is formed centrally in an end of the unit toward the nozzle needle, the end of the nozzle needle (14) toward the valve piston being received in said blind bore.

3. The fuel injector according to claim 2, wherein on the end of the nozzle needle (14) toward the valve piston (6), a thrust peg (15) is embodied, said thrust peg protruding into the guide sleeve (16) or into a central blind bore formed on the end of the valve piston (6).

4. The fuel injector according to claim 2, further comprising a thrust rod (8) cooperating axially with said valve piston (6), said thrust rod (8) being disposed so as to be slightly pivotable relative to the longitudinal axis of the valve piston (6).

5. The fuel injector according to claim 1, further comprising a bearing disk on the face end of the guide sleeve (16) remote from the nozzle needle (14) between the guide sleeve (16) and a nozzle spring (18), said bearing disk forming an abutment for the nozzle spring (18).

6. The fuel injector according to claim 5, further comprising a cylindrical recess (22) formed on said guide sleeve (16), on its face end toward the nozzle needle (14).

7. The fuel injector according to claim 5, further comprising an adjusting piece (19) disposed between the nozzle needle (14) and either the valve piston (6) or the thrust rod (8).

8. The fuel injector according to claim 1, further comprising a collar on the guide sleeve (16), on its face end remote from the nozzle needle (14), said collar (28) forming an abutment for the nozzle spring (18).

9. The fuel injector according to claim 8, further comprising a cylindrical recess (22) formed on said guide sleeve (16), on its face end toward the nozzle needle (14).

10. The fuel injector according to claim 1, wherein the dimensions of the guide sleeve (16), on its face end remote from the nozzle needle (14), are adapted to the dimensions of the nozzle spring (18).

11. The fuel injector according to claim 10, further comprising a thrust rod (8) cooperating axially with said valve piston (6), said thrust rod (8) being disposed so as to be slightly pivotable relative to the longitudinal axis of the valve piston (6).

12. The fuel injector according to claim 1, further comprising an adjusting piece (19) disposed between the nozzle needle (14) and either the valve piston (6) or the thrust rod (8).

13. The fuel injector according to claim 1, further comprising a bearing disk on the face end of the guide sleeve (16) remote from the nozzle needle (14) between the guide sleeve (16) and a nozzle spring (18), said bearing disk forming an abutment for the nozzle spring (18).

14. The fuel injector according to claim 1, further comprising on the guide sleeve (16), on its face end remote from the nozzle needle (14), said collar (28) forming an abutment for the nozzle spring (18).

15. The fuel injector according to claim 1, wherein the dimensions of the guide sleeve (16), on its face end remote from the nozzle needle (14), are adapted to the dimensions of the nozzle spring (18).

16. The fuel injector according to claim 1, further comprising a cylindrical recess (22) formed on said guide sleeve (16), on its face end toward the nozzle needle (14).

17. The fuel injector according to claim 1, further comprising an adjusting piece (19) disposed between the nozzle needle (14) and either the valve piston (6) or the thrust rod (8).

18. In a fuel injector for injecting fuel in an internal combustion engine, said injector having an injector housing (1) which communicates with a central high-pressure reservoir and a nozzle needle (14) that cooperates with a valve piston (6) which is axially displaceable and guided in a valve piece (2), the improvement wherein the end of the nozzle needle (14) toward the valve piston (6) protrudes into a guide sleeve (16), and the end of the valve piston (6) or an end of a thrust rod (8) triggered by the valve piston (6), oriented toward the nozzle needle (14) is also received in the guide sleeve (16), further comprising a thrust rod (8) being disposed so as to be slightly pivotable relative to the longitudinal axis of the valve piston (6).

19. The fuel injector according to claim 18, further comprising a blind bore (7), in the end of the valve piston (6) toward the nozzle needle (14), said blind bore (7) receiving a tapering end of the thrust rod (8).

20. In a fuel injector for injecting fuel in an internal combustion engine, said injector having an injector housing (1) which communicates with a central high-pressure reservoir and a nozzle needle (14) that cooperates with a valve piston (6) which is axially displaceable and guided in a valve piece (2), the improvement wherein the end of the nozzle needle (14) toward the valve piston (6) protrudes into a guide sleeve (16), and the end of the valve piston (6) or an end of a thrust rod (8) triggered by the valve piston (6), oriented toward the nozzle needle (14) is also received in the guide sleeve (16), wherein the end of the valve piston (6) toward the nozzle needle (14) can be deflected elastically in the radial direction out of the axis of symmetry of the valve piston (6).

21. The fuel injector according to claim 20, further comprising a cylindrical recess (22) formed on said guide sleeve (16), on its face end toward the nozzle needle (14).

22. The fuel injector according to claim 20, further comprising a bearing disk on the face end of the guide sleeve (16) remote from the nozzle needle (14) between the guide sleeve (16) and a nozzle spring (18), said bearing disk forming an abutment for the nozzle spring (18).

23. The fuel injector according to claim 20, further comprising a collar on the guide sleeve (16), on its face end remote from the nozzle needle (14), said collar (28) forming an abutment for the nozzle spring (18).

24. The fuel injector according to claim 20, wherein the dimensions of the guide sleeve (16), on its face end remote from the nozzle needle (14), are adapted to the dimensions of the nozzle spring (18).

25. The fuel injector according to claim 20, further comprising an adjusting piece (19) disposed between the nozzle needle (14) and either the valve piston (6) or the thrust rod (8).

26. The fuel injector according to claim 20, wherein a thrust rod (8) is provided, which cooperates axially with said valve piston (6), said thrust rod (8) being disposed so as to be slightly pivotable relative to the longitudinal axis of the valve piston (6).

27. The fuel injector according to claim 20, further comprising a blind bore (7), in the end of the valve piston (6) toward the nozzle needle (14), said blind bore (7) receiving a tapering end of the thrust rod (8).

28. The fuel injector according to claim 20, wherein the end of the valve piston (6) toward the nozzle needle (14) can be deflected elastically in the radial direction out of the axis of symmetry of the valve piston (6).

* * * * *